US006530165B2

(12) United States Patent
Griesemer et al.

(10) Patent No.: US 6,530,165 B2
(45) Date of Patent: Mar. 11, 2003

(54) ASSEMBLY FOR MOUNTING FLEXIBLE SHEET ON STRUCTURE

(75) Inventors: Daniel A. Griesemer, Sandy, UT (US); Paul F. Bauer, Layton, UT (US)

(73) Assignee: Impact Imaging, Inc., Kaysville, UT (US)

( * ) Notice: Subject to any disclaimer, the term of this patent is extended or adjusted under 35 U.S.C. 154(b) by 0 days.

(21) Appl. No.: 10/040,102

(22) Filed: Jan. 4, 2002

(65) Prior Publication Data

US 2002/0056215 A1 May 16, 2002

Related U.S. Application Data

(63) Continuation of application No. 09/397,467, filed on Sep. 16, 1999, now Pat. No. 6,339,889, which is a continuation-in-part of application No. 09/274,948, filed on Mar. 23, 1999, now abandoned.

(51) Int. Cl.[7] ..... G09F 17/00
(52) U.S. Cl. ..... 40/603; 40/590; 160/378
(58) Field of Search ..... 40/603, 604, 590, 40/591; 160/328, 371, 378

(56) References Cited

U.S. PATENT DOCUMENTS

| | | | | |
|---|---|---|---|---|
| 4,558,475 | A | 12/1985 | O'Brien | |
| 4,580,361 | A | 4/1986 | Hillstrom et al. | |
| 4,922,988 | A | 5/1990 | Loomis | |
| 5,044,102 | A | 9/1991 | Finch et al. | |
| 5,046,545 | A | 9/1991 | Loomis et al. | |
| 5,077,924 | A | 1/1992 | Yamaguchi | |
| 5,140,765 | A | 8/1992 | King | |
| 5,255,466 | A | 10/1993 | Synder | |
| 5,349,722 | A | 9/1994 | Pardue | |
| 5,373,653 | A | 12/1994 | Suzuki | |
| 5,373,655 | A | 12/1994 | Suzuki | |
| 5,408,770 | A | 4/1995 | Suzuki | |
| 5,507,109 | A | 4/1996 | Rinzler | |
| 5,685,099 | A | 11/1997 | Favata | |
| 5,845,423 | A | 12/1998 | Hicks | |
| 6,041,535 | A | 3/2000 | Holloway et al. | |
| 6,167,649 | B1 | 1/2001 | Palmeri | |
| 6,209,245 | B1 * | 4/2001 | Wittenberg | 160/378 |
| 6,250,002 | B1 * | 6/2001 | Wittenberg | 160/378 |

* cited by examiner

*Primary Examiner*—Lynne H. Browne
*Assistant Examiner*—James M. Hewitt
(74) *Attorney, Agent, or Firm*—Workman, Nydegger & Seeley

(57) ABSTRACT

An assembly for mounting a flexible display sheet to a structure includes an adjustment bracket having a first end and an opposing second end, the display sheet being secured to the first end of the adjustment bracket. A brace is rigidly attached to the structure, the brace having an opening extending therethrough. A coupling pin has a first end and an opposing second end, the first end of the coupling pin being mounted to the second end of the adjustment bracket, the second end of the coupling pin extending through the opening on the brace. An advancing nut is threadedly mounted on the second end of the coupling pin, the advancing nut being configured to bias against the brace so as to advance the coupling pin through the opening on the brace as the advancing nut is threaded onto the coupling pin.

25 Claims, 4 Drawing Sheets

ASSEMBLY FOR MOUNTING FLEXIBLE SHEET ON STRUCTURE

CROSS-REFERENCE TO RELATED APPLICATIONS

This application is a continuation of application Ser. No. 09/397,467, filed Sep. 16, 1999, now U.S. Pat. No. 6,339,889 which is a continuation-in-part of application Ser. No. 09/274,948, filed on Mar. 23, 1999, now abandoned, the Detailed Descriptions of the Preferred Embodiments and corresponding drawings of each of the above-identified applications being incorporated herein by specific reference.

BACKGROUND OF THE INVENTION

1. The Field of the Invention

The present invention relates to mounting assemblies for flexible sheets and, more specifically, assemblies for mounting flexible sheets under tension on any desired structure.

2. The Relevant Technology

Billboards are a popular and effective advertising medium. A conventional billboard comprises an enlarged upstanding frame having an expansive plain or board attached thereto. Advertising can be painted directly onto the face of the board. More commonly, however, advertising is printed or silkscreened onto enlarged vinyl or paper sheets which are then secured to the board by an adhesive. Most billboard are located adjacent to a freeway or other roadway so as to maximize public exposure.

Although conventional billboards are effective, the demand for additional advertising has promoted the need to find unique ways and locations for displaying advertising. For example, there is an increased demand for affixing advertising onto the side of buildings or other previously standing structures. The problem encountered, however, is that it is often difficult, and at times undesirable, to mount a conventional display board onto the side of such structures. Furthermore, many zoning and building restrictions preclude the attachment of a display board onto the side of buildings. The display boards are often rejected on the grounds that the display boards comprise a separate element that extends too far from the side of the building. Similarly, it is often impractical or undesired to secure an advertising sheet directly onto the side of a building or structure by an adhesive. Often, the side of the building is insufficiently flat to secure the advertising sheet. Furthermore, use of the adhesive can mare the building surface.

Additional desired advertising space is found on the side of vehicles such as buses, automobiles, and tractor trailers. Here again, legislation precludes the attachment of large display boards onto the side of vehicles. Such boards are often rejected on the grounds that the boards project too far from the side of the vehicles. In one approach to overcome this limitation, silkscreen or other printed advertising sheets have been made for direct attachment onto the side of a vehicle by an adhesive. Such advertising sheets, however, can be difficult and labor intensive to attach and remove. Furthermore, the removal of such sheets can pull off the vehicle paint.

Although vinyl advertising sheets can simply be directly bolted to the side of a trailer or vehicle, conventional bolting makes it difficult to adequately stretch or tension the sheets so that they have a flat uniform appearance. Furthermore, it is often desirable to quickly exchange or replace advertisement sheets. This is particularly important with regard to truck trailers wherein the advertising sheets must be replaced during the period in which the trailer is being either loaded or unloaded. Conventional mounting systems are often labor intensive and time consuming in the replacement process.

In one attempt to overcoming some of the above problems, conventional cranks have been mounted onto the side of a truck trailer. Advertising sheets are formed having straps projecting from the side thereof. Accordingly, by tightening the straps through the cranks, the advertising sheets can be secured to the side of the trailer. Such an assembly, however, requires specially made advertising sheets wherein the straps must be aligned with the cranks. Furthermore, the cranks can produce localized stresses on the advertising sheets at the site of the straps, thereby producing an uneven appearance. Finally, the cranks project relatively far from the side of the trailer, thereby decreasing the aesthetic appearance and increasing the potential danger to those standing adjacent to the trailer.

BRIEF SUMMARY OF THE INVENTION

Accordingly, it is an object of the present invention to provide improved assemblies for mounting flexible sheets onto a desired structure.

To achieve the foregoing and other objects, and in accordance with the invention as embodied and broadly described herein, a mounting assembly is provided for removably securing a flexible display sheet to a structure such as the side of a building or vehicle. The display sheet has a front face that extends to an encircling perimeter edge. Secured at the perimeter edge is a small diameter retention line. The display sheet is configured such that advertising can be printed, silkscreened, or otherwise disposed on the front face thereof.

The mounting assembly includes a mounting bracket, adjustment bracket, and brace. The mounting bracket and brace are configured for ridged attachment to the side of the structure, such as by bolts. The mounting bracket has a coupling channel that extends along a first end thereof and communicates with the exterior through a narrow mouth. The coupling channel and mouth are configured to slidably receive and retain the top edge of the display sheet when the mounting bracket is rigidly mounted to the structure.

The adjustment bracket has a front face extending between a first end and an opposing second end. A coupling channel also extends along the first end of the adjustment bracket and communicates with the exterior through a narrow mouth. The coupling channel and mouth are configured to slidably receive and retain the bottom edge of the display sheet such that the front face of the adjustment bracket can be freely disposed adjacent to the structure.

A receiving channel extends along the second end of the adjustment bracket and communicates with the exterior through a narrow mouth. A plurality of retention nuts are slidably disposed within the receiving channel. The retention nuts are configured to preclude annular rotation therein. The first end of a threaded bolt is screwed into each retention nut such that each bolt projects through the mouth of the receiving channel to an opposing second end. A positioning nut is also threaded onto each bolt and selectively biased against the exterior of the adjustment bracket so as to secure each bolt in a desired location along the length of the adjustment bracket.

The brace has a front face that also extends between a first end and an opposing second end. A plurality of spaced apart elongated slots extend through the brace between the opposing ends. Once the brace is secured to the structure, the second end of each bolt is disposed through a corresponding slot on the brace. An adjustment nut is then threadedly engaged at the second end of each bolt such that as each adjustment nut is advanced, each adjustment nut biases against the brace causing each bolt and the attached adjustment bracket to advance towards the brace. As a result, the display sheet is vertically tensioned between the mounting bracket and the adjustment bracket.

If desired, a similar assembly can also be mounted along the sides of the display sheet so as to also horizontally tension of the display sheet. Once the display sheet is tensioned, a cover comprised of linear and corner members is mounted to the mounting and adjustment brackets so as to substantially cover the mounting and adjustment brackets, brace, and perimeter edge of the display sheet over the structure.

BRIEF DESCRIPTION OF THE DRAWINGS

In order that the manner in which the above-recited and other advantages and objects of the invention are obtained, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION OF THE PREFERRED EMBODIMENTS

Figure 1:
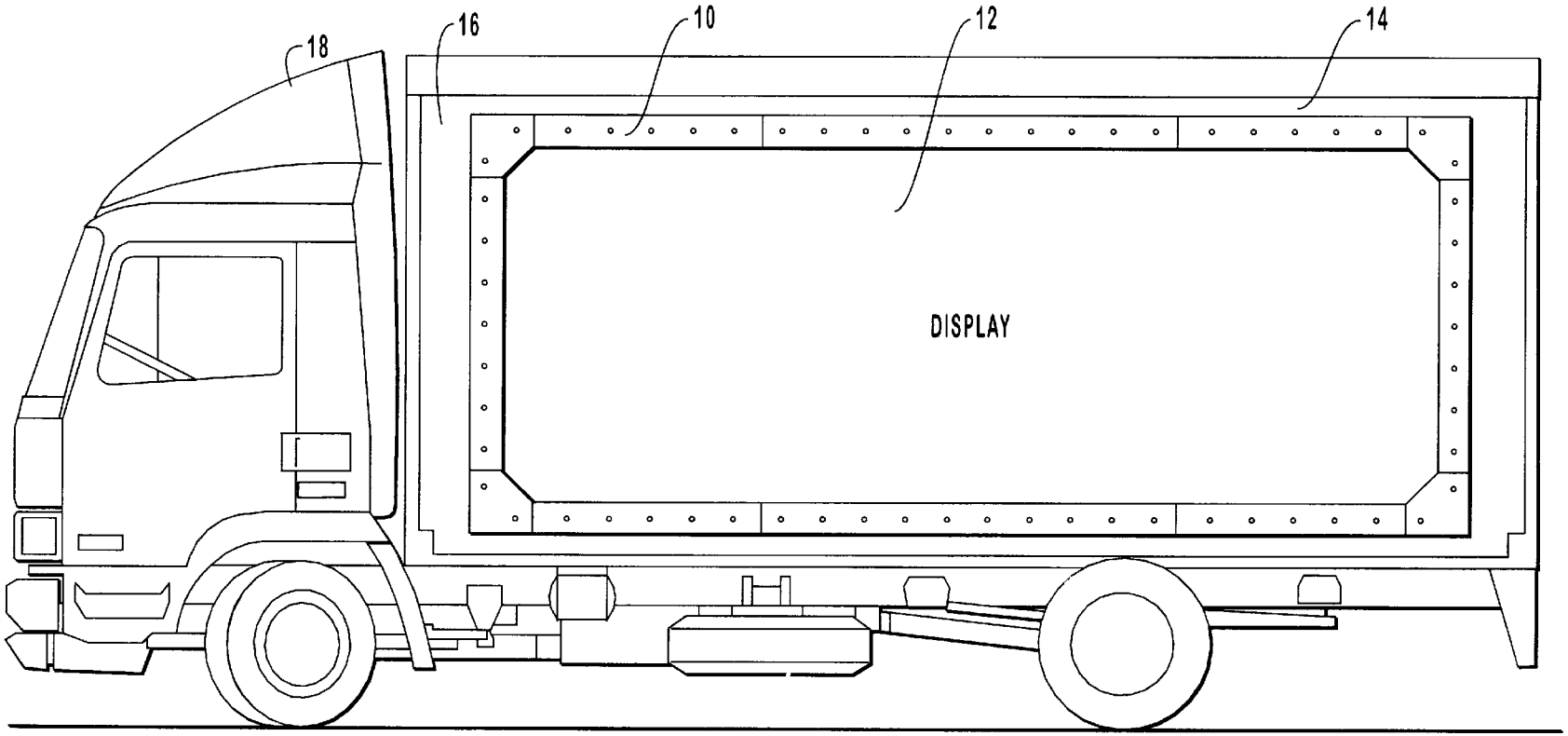
FIG. 1 is a side view of the inventive assembly securing a flexible display sheet to the side of a truck.

Depicted in FIG. 1 is one embodiment of an inventive mounting assembly 10 incorporating features of the present invention. Mounting assembly 10 is configured for securing a flexible display sheet 12 to a structure 14. In the embodiment depicted, structure 14 comprises a side 16 of a cargo truck 18. As used in the specification and appended claims, the term "structure" is broadly intended to include any type of structure on which it is desired to mount a display. By way of example and not by limitation, the structure can include a trailer, bus, automobile, wall, building, support frame, billboard, and the like.

Figure 2:
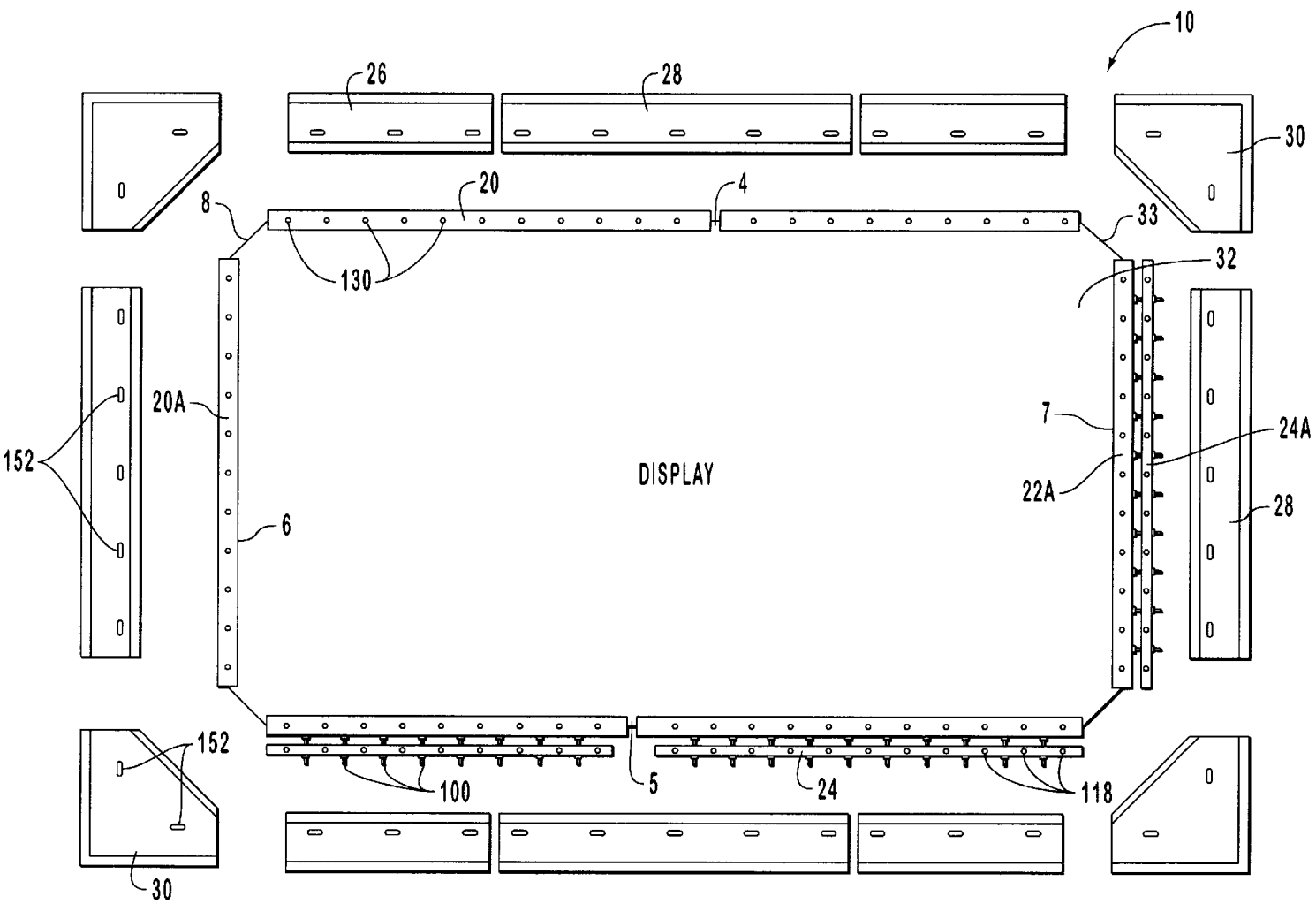
FIG. 2 is a front view of the assembly shown in FIG. 1 having the cover exploded therefrom.

Depicted in FIG. 2, display sheet 12 has a front face 32 that extends to a perimeter edge 33. Although display sheet 12 can have any desired configuration, in the embodiment depicted, display sheet 12 has a substantially rectangular configuration wherein perimeter edge 33 includes a top edge 4, a bottom edge 5, and opposing side edges 6 and 7. Corners 8 of display sheet 12 are cut.

Figure 3:
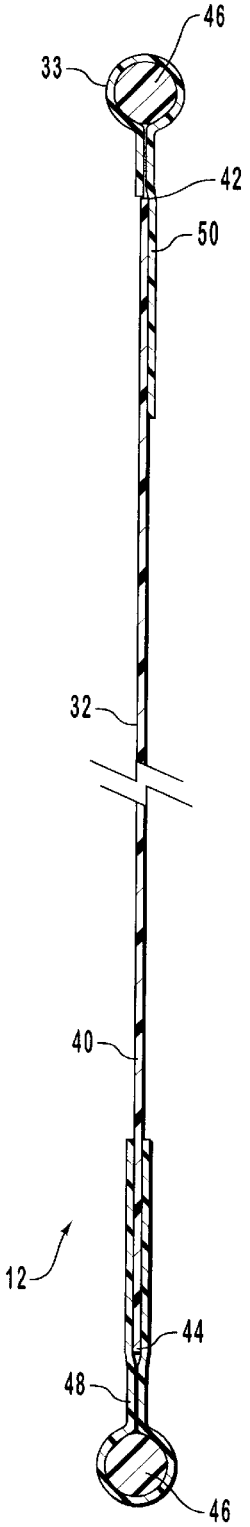
FIG. 3 is a cross sectional side view of the display sheet shown in FIG. 2.

In the embodiment depicted in FIG. 3, display sheet 12 comprises a display portion 40 having a sheet-like configuration extending between opposing edges 42 and 44; retention line 46; and means for securing retention line 46 to edges 42 and 44 of display portion 40. Display portion 40 can be made of any sheet-like material such as paper, extruded sheets such as vinyl, or woven fabrics such as cotton, nylon, or other synthetic materials.

Retention line 46 has a diameter that is greater than the thickness of display portion 40. As used in the specification and appended claims, the term "retention line" is broadly intended to include relatively small diameter elongated members which can be either flexible or rigid. In one embodiment, retention line 46 comprises an extruded flexible plastic line. By way of example, in other embodiments retention line 46 can comprise cord, wood or metal stylets, tubing, rolled material, and the like. Retention line 46 can have a circular or any other polygonal or irregular transverse cross section.

By way of example and not by limitation, means for securing retention line 46 to display portion 40 includes a sleeve 48 having opposing ends folded together so as to enclose retention line 46 and edge 44 of display portion 40 therebetween. Sleeve 48 has an inside coating of a heat sealing material. Accordingly, as heat is applied to sleeve 48, sleeve 48 bonds to retention line 46 and display portion 40. Sleeve 48 and retention line 46 can be purchased as an integral unit referred to as Keder material which is available from Seattle Industrial Textile Company out of Seattle, Wash.

In the alternative, adhesives, staples, stitching, and other conventional mechanisms can also be used to secure sleeve 48 to display portion 40. In another alternative, a single sided sleeve 50 can be used to secure retention line 46 to edge 42. As a result, only one side of display portion 40 is secured to sleeve 50. Single sided sleeve 50 can be easier to align and attach to display portion 40.

In contrast to using a discrete sleeve, retention line 46 can also be secured to display portion 40 by simply folding the edge of display portion 40 over retention line 46 and securing the folded portion in place such as by stitching, staples, or adhesive. Similarly, retention line 46 can be directly secured to the edge of display portion 40 by stitching, staples, adhesives or the like.

Figure 7:
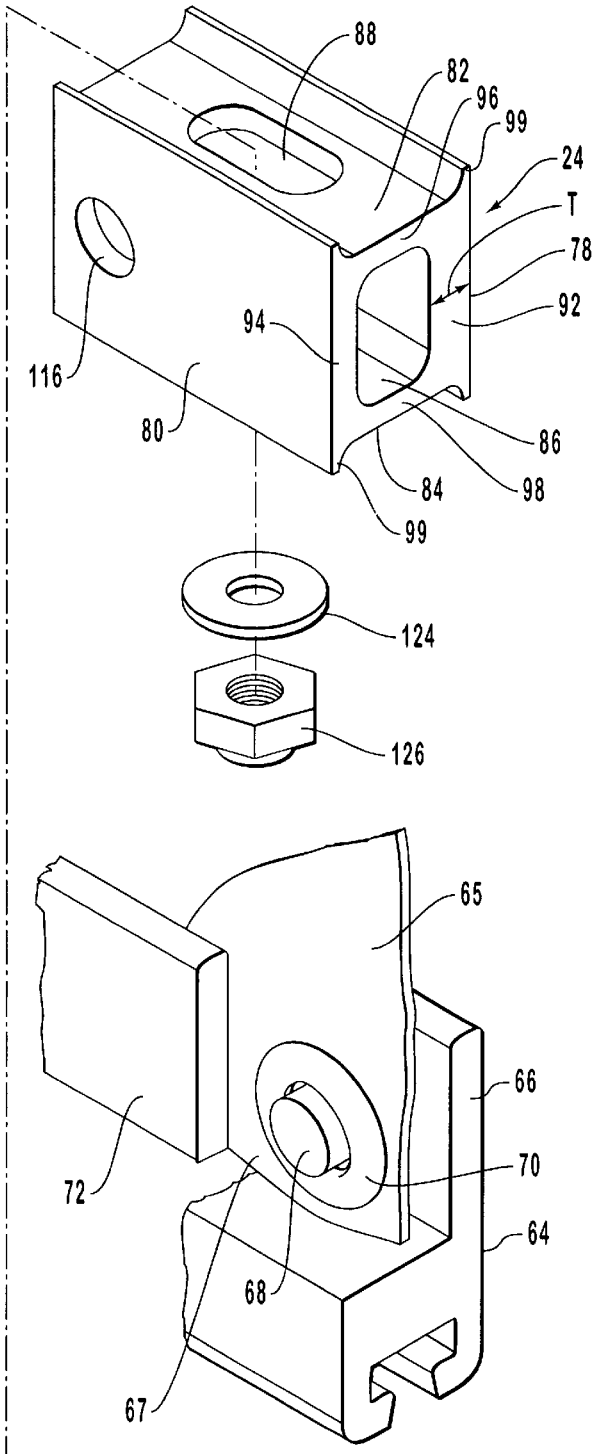
FIG. 7 is a perspective view of an alternative bracket for the assembly shown in FIG. 6.

The present invention also envisions that display sheet 12 need not include a discrete retention line or sleeve. For example, depicted in FIG. 7 is a display sheet 65 having a perimeter edge 67 that is substantially flat. As such, display sheet 12 can have a continuous sheet-like configuration. Alternatively, the edges of a display sheet can be rolled up or bunched to form a simulated retention line thereat.

Depicted in FIG. 2, mounting assembly 10 includes a mounting bracket 20, an adjustment bracket 22, and a brace 24. In one embodiment, brackets 20 and 22 and brace 24 are elongated members that are manufactured by extruding and drilling. The member are typically made from aluminum or plastic but can also be made from other materials. Brackets 20 and 22 and brace 24 typically each have a length in a range between about 1 meter to about 3 meters with about 2 meters to about 2.5 meters being more preferred. Typically, members of about 2.5 meters or less are preferred for ease in delivering the assembly through the mail. Brackets 20 and 22 and brace 24 are configured for securing and tensioning display sheet 12 on structure 14. A surrounding cover 26 is selectively mounted to brackets 20 and 22 so as to cover brackets 20 and 22, brace 24, and the perimeter edge of display sheet 12. As discussed later in greater detail, cover 26 comprises linear members 28 and corner members 30.

Figure 4:
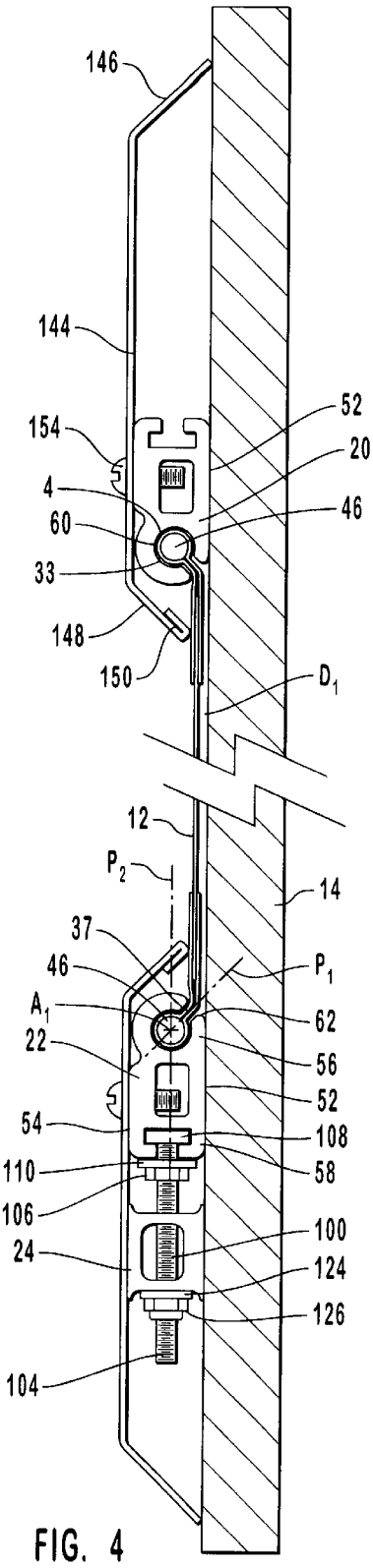
FIGS. 4 and 5 are cross sectional side views of the assembly shown in FIG. 1 at spaced apart locations.
Figure 6:
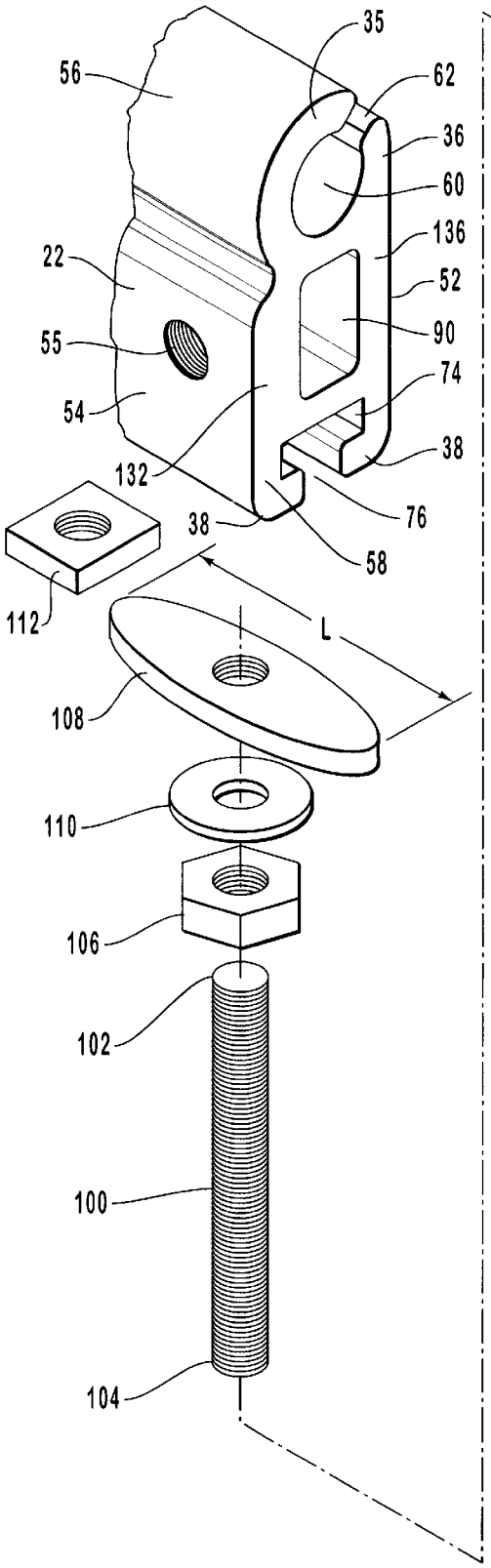
FIG. 6 is an exploded perspective view of a portion of the assembly shown in FIG. 5.

Depicted in FIGS. 4 and 6, adjustment bracket 22 has a front face 52 and an opposing back face 54 each extending between a first end 56 and an opposing second end 58. In one embodiment of the present invention, means are provided for securely retaining a portion of perimeter edge 33 of display sheet 12 along first end 56 of adjustment bracket 22. By way of example and not by limitation, an elongated arcuate finger 35 and substantially linear thumb 36 project at first end 56 so as to bound a coupling channel 60 that runs along the length of adjustment bracket 22. Coupling channel 60 has a substantially circular transverse cross section and communicates with the exterior through a narrow mouth 62, Coupling channel 60 is configured to slidably receive retention line 46 such that sleeve 48 passes through mouth 62. Retention line 46 has a diameter larger than mouth 62 so as to prevent retention line 46 from passing therethrough.

As depicted in FIGS. 4 and 6, in one embodiment mouth 62 of adjustment bracket 22 is configured to open towards structure 14 when front face 52 of adjustment bracket 22 is disposed against structure 14. This is a result of finger 35 having a greater length than thumb 36. Expressed in other terms, mouth 62 is configured such that a plane $P_1$ projecting from a central longitudinal axis $A_1$ of coupling channel 60 through mouth 62 intersects structure 14 when front face 52 of adjustment bracket 22 is disposed against structure 14. Accordingly, a portion 37 of flexible sheet 12 passing through mouth 62 is angled to intersect with structure 14. This positioning of mouth 62 minimizes the distance D between flexible sheet 12 and structure 14. In one embodiment, the maximum distance $D_1$ between flexible sheet 12 and structure 14 is typically less than about 3 cm with less than about 2 cm being preferred and less than about 1 cm being more preferred. The above measurements for the distance D are also applicable for the lateral distance between flexible sheet 12 and a front face 78 of brace 24, as discussed later, when front face 78 is mounted on structure 14.

The present invention also envisions a variety of other embodiments for securely retaining a portion of perimeter edge 33 of display sheet 12 along first end 56 of adjustment bracket 22. For example, depicted in FIG. 7, an adjustable bracket 64 is shown having a first member 66 with a pin 68 projecting therefrom. A display sheet 65 has a grommet 70 formed at the edge thereof which is configured to receive pin 68. A second member 72 can then be secured to first member 66 over pin 68, so as to secure display sheet 65 to adjustable bracket 64. There are of course, a variety of other conventional attachments structures such as clips, clamps, hooks, fasteners, and the like that can also be used.

In yet another embodiment, mouth 62 can also be configured such that a plane $P_2$ projecting from the central longitudinal axis $A_1$ of coupling channel 60 through mouth 62 is disposed substantially parallel with structure 14 and/or face 52 of adjustment bracket 22.

Returning to FIG. 6, a pair of inwardly facing substantially L-shaped fingers 38 are formed at second end 58 of adjustment bracket 22. Fingers 38 bound a receiving channel 74 longitudinally extending along second end 58 of adjustment bracket 22. In one embodiment, second channel 74 has a substantially rectangular transverse cross section and communicates with the exterior through a narrow mouth 76.

Longitudinally extending through the center of adjustment bracket 22 is a passageway 90. Extending between passageway 90 and front face 52 is an inside wall 136. An outside wall 132 extends between back face 54 and passageway 90. As will be discussed later with regard to cover 26, a threaded hole 55 projects into adjustment bracket 22 through back face 54.

Also depicted in FIG. 6, brace 24 is an elongated member having an inside wall 92 with a front face 78 and an opposing outside wall 94 with a back face 80. Extending between walls 92 and 94 is a top wall 96 having a top surface 82 and an opposing bottom wall 98 having a bottom surface 84. Walls 92, 94, 96, and 98 bound a passageway 86 longitudinally extending through brace 24. Inside wall 92 and outside wall 94 each terminate at opposing ends with a freely exposed leg 99 projecting thereat. Legs 99 increase the stability of brace 24 and incorporate mechanical properties of an I-beam into brace 24. A plurality of spaced apart openings 88 extend in alignment through top wall 96 and bottom wall 98. Opening 88 is depicted as an elongated slot. In alternative embodiments, however, opening 88 can be a circular hole or any other desired shape.

In the embodiment depicted, brace 24 has a substantially square transverse cross section. In alternative embodiments, brace 24 can have a substantially U-shaped transverse cross section. For example, brace 24 can consist of walls 92, 96, and 98. In another embodiment, brace 24 can have a substantially L-shaped transverse cross section. For example, brace 24 can consist of walls 92 and 98.

Figure 5:
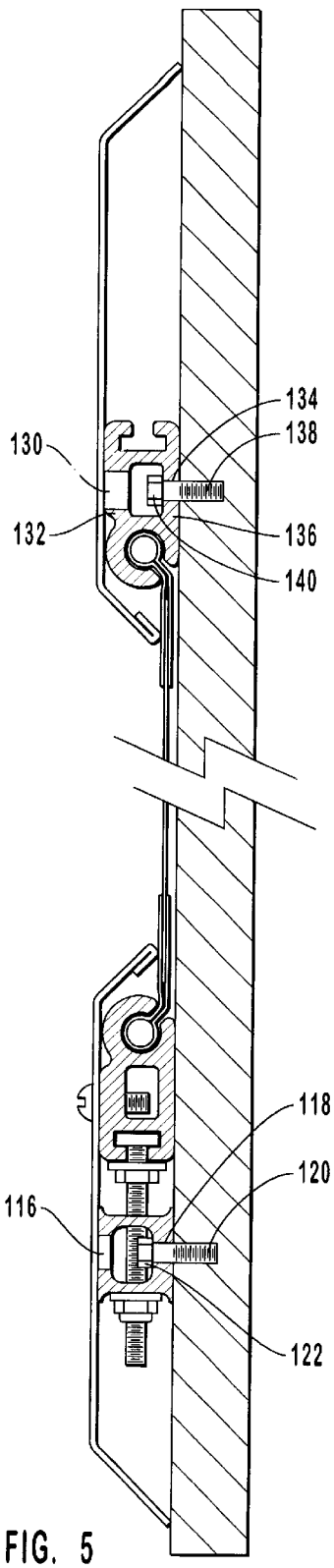

Means are also provided for securing brace 24 to structure 14 such that front face 78 is biased against structure 14. By way of example, as depicted in FIGS. 5 and 6, an enlarged first aperture 116 extends through outside wall 94 A smaller second aperture 118 extends through inside wall 92. Apertures 116 and 118 are configured such that a bolt 120 having a head 122 can be passed through apertures 116 and 118 so that head 122 is biased against inside wall 93 when bolt 120 is screwed into structure 14. Alternative means for securing include wood or metal screws, nails, staples, adhesives, and other conventional fasteners known in the art. To support bolt 120 without failure of brace 24, in one embodiment inside wall 92 has a thickness T that is greater than the thickness of outside wall 94.

In another embodiment of the present invention, means are provided for selectively moving adjustment bracket 22 relative to brace 24 when brace 24 is rigidly mounted to structure 14 and adjustment bracket 22 is slidably disposed directly adjacent to structure 14. As depicted in FIG. 6, by way of example and not by limitation, a coupling pin 100 is provided have a first end 102 and an opposing second end 104. In the depicted embodiment, coupling pin 102 comprises a threaded bolt.

Selectively threaded onto first end 102 of coupling pin 100 is a positioning nut 106 and a retention nut 108 with a washer 110 disposed therebetween. In this configuration, as depicted in FIG. 4, retention nut 108 is slidably received within receiving channel 74 such that coupling pin passes through mouth 76 thereof. Positioning nut 106 can then be selectively tightened to bias via wash 110 against the exterior of adjustment bracket 22, thereby securing coupling pin 100 at a desired location along adjustment bracket 22 and precluding unwanted annular rotation of coupling pin 100.

Retention nut 108 is configured to be slidably received within receiving channel 74 so as to prevent annular rotation of retention nut 108 therein. For example, retention nut 108 is configured having an elongated elliptical configuration having a length L longer than the width of receiving channel 74. In an alternative embodiment, retention nut 108 can be replaced with a conventional square nut 112 wherein square nut 112 has a width comparable to the width of second channel 104 so as to prevent annular rotation therein. One skilled in the art would appreciate that their are a variety of different configurations of nuts which can be used for threaded attachment with first end 102 of coupling pin 100 and yet would not facilitate annular rotation within receiving channel 74. The benefit of precluding annular rotation of the retention nut is that should a coupling pin fail, the coupling pin can simple be unthreaded and replaced without having to slide retention nut 108 out of receiving channel 74. This benefit is more apparent where there are a plurality of retention nuts and corresponding coupling pins disposed within receiving channel 74.

Second end 104 of coupling pin 100 is selectively pass through corresponding openings 88 on brace 24 such that second end 104 projects past bottom wall 98. A washer 124 and advancing nut 126 are then disposed on second end 104. In one embodiment, advancing nut 126 comprises a Nyloc nut. Advancing nut 126 is threaded onto coupling pin 100 such that advancing nut 126 biases via washer 124 against brace 24. Further tightening of advancing nut 126 pulls coupling pin 100 through brace 24 and thus draws adjustment bracket 22 towards brace 24.

The present invention also envisions a variety of alternative embodiments which can be used for selectively moving adjustment bracket 22 relative to brace 24. For example, coupling pin 100 can have a fixed head position at first end 102 as opposed to threaded nut 108. Furthermore, in contrast to having advancing nut 126, a lever arm can be positioned at second end 104 such that as the lever arm is biased against brace 24, coupling pin 100 is advanced through brace 24. In yet other embodiments, select nuts can be removed from the assembly by forming threaded apertures in one or both of adjustment bracket 22 and brace 24. In still other embodiments, the advancing nut can be replaced by forming holes that transversely extend through second end 104 of coupling pin 100. By manually pulling down on coupling pin 100, a key or pin can be inserted within the transverse hole so as to secure the coupling pin in the desired location. Those skilled in the art, will appreciate that their are a variety of other conventional methods that can similarly be used.

The present invention also includes means for securing top edge 4 of display sheet 12 to structure 14. By way of example and not by limitation, one embodiment of the means for securing top edge 4 comprises mounting bracket 20. As depicted in FIGS. 4 and 5, mounting bracket 20 has, for simplicity in manufacturing, a configuration substantially identical to adjustment bracket 22. As such, the reference characters identified with the elements of adjustment bracket 22 also relate to the elements of mounting bracket 20. Top edge 4 of display sheet 12 is thus secured to mounting bracket 20 by sliding retention line 46 within coupling channel 60.

As depicted in FIG. 5, means are also provided for securing mounting bracket 20 to structure 14 such that front face 52 is biased against structure 14. By way of example, an enlarged first aperture 130 extends through outside wall 132. A smaller second aperture 134 extends through inside wall 136. Apertures 130 and 134 are configured such that a bolt 138 having a head 140 can be passed through apertures 132 and 136 so that head 140 is biased against inside wall 136 when bolt 138 is screwed into structure 14. Alternative means for securing include wood or metal screws, nails, staples, adhesives, and other conventional fasteners known in the art.

In alternative embodiments of the means for securing top edge 4 of display sheet 12 to structure 14, mounting bracket 20 can be manufactured without receiving channel 74. Mounting bracket 20 can also be configured in the same alternatives as discussed with regard to adjustment bracket 22. In yet other embodiments, since top edge 4 does not move, the means for securing top edge 4 can comprise hooks, clamps, bolt, screws and the like that directly secure top edge 4 to structure 14.

Returning back to FIG. 2, mounting assembly 10 is assembled and used pursuant to the following steps which can be accomplished in a variety of different ordered sequences. In one method of assembly, one or more upper mounting brackets 20 are secured to structure 14 by screwing bolts 138 through corresponding spaced apart apertures 130 and 134 as previously discussed with regard to FIG. 5. Next, top edge 4 of display sheet 12 is attached to upper mounting brackets 20 by sliding retention line 46 through coupling channel 60. As a result, display sheet 12 is freely suspended by top edge 4 secured to mounting bracket 20.

Next, a side mounting bracket 20A is coupled with side edge 6 of display sheet 12 by manually sliding retention line 46 within coupling channel 60 thereof. Side mounting bracket 20A can then be secured to structure 14 using the same process as with regard to top mounting brackets 20.

One or more lower braces 24 and side braces 24A are secured to structure 14 by passing bolts 120 through corresponding spaced apart apertures 116 and 118 as previously discussed with regard to FIG. 5. Next, one or more adjustment brackets 22, 22A are coupled with bottom edge 5 and side edge 7 of display sheet 12 by sliding retention line 46 through corresponding coupling channel 60. Slidably disposed within each receiving channel 74 of each adjustment bracket 22, 22A are a plurality of coupling pins 100. Each coupling pin 100 is slidably moved along adjustment bracket 22, 22A so as to be aligned with a corresponding opening 88 in adjacent braces 24, 24A. The second end of each coupling pin 100 is then passed through corresponding opening 88 after which washer 124 and advancing nut 126 are screwed onto each end 102 as previously discussed with regard to FIGS. 4 and 6.

In this configuration, advancing nuts 126 are selectively tightened such that locking pins 100 are advanced through braces 24, 24A. As a result, adjustment brackets 22, 22A are advanced towards braces 24, 24A. In so doing, display sheet 12 is both horizontally and vertically tightened between mounting brackets 20, 20A and adjustment brackets 22, 22A. In alternative embodiments, the present invention envisions that where display sheet 12 is sufficiently long, mounting bracket 20A can be replaced with another set of adjustment bracket 22A and brace 24A. As a result, display 12 would be tightened from both sides. It is also envisioned that top mounting bracket 20 can be replaced with another set of adjustment bracket 22 and brace 24. In yet another embodiment, it is appreciated that display sheet 12 need only be mounted and tightened either between its side edges or between the top and bottom edges.

Once display sheet 12 is tightened, cover 26 is mounted to mounting brackets 20, 20A and adjustment brackets 22, 22A. As depicted in FIG. 4, each element of cover 26 comprises a substantially flat base 144 having an angled wing 146 and 148 projecting from the opposing sides thereof. Wing 148 terminates at a rounded end 150 which is configured for positioning over display sheet 12.

The present invention also includes means for securing cover 26 to a corresponding mounting bracket 20, 20A and adjustment bracket 22, 22A. By way of example and not by limitation, as depicted in FIGS. 2 and 4, a plurality of spaced apart elongated slots 152 extend through linear members 28 and corner members 30 of cover 26. During attachment, each linear member 28 is first aligned over corresponding mounting brackets 20, 20A and adjustment brackets 22, 22A such that elongated slots 152 are aligned over threaded holes 55. A bolt 154 is then passed through each slot 152 and screwed into a corresponding threaded hole 55. As a result, linear members 28 are secured to the mounting and adjustment brackets. Next, corner members 30 are positioned over the ends of adjacent linear members 28. Bolts 154 are then passed through aligned slots 152 so as to screw into holes 55. In alternative embodiments, it is also envisioned that cover 26 can be attached to braces 24, 24A rather than adjustment brackets 22, 22A.

Cover 26 not only provides a nice esthetic finish to mounting assembly 10 but also covers mounting brackets 20, 20A; adjustment brackets 22, 22A; braces 24, 24A; and perimeter edge 33 of display sheet 12 so as to protect these elements from the weather and exterior elements, such as tree branches, that may damage the elements. As depicted in FIG. 5, in one embodiment, the maximum lateral distance $D_2$ between structure 14 on which front face 78 of brace 24 is mounted and the top surface of cover 26 is less than about 7 cm, with less than about 5 cm being preferred, and less than about 3 cm being more preferred.

The present invention may be embodied in other specific forms without departing from its spirit or essential characteristics The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. An assembly for mounting a flexible display sheet having a perimeter edge to a structure, the assembly comprising:

an adjustment bracket having a first end and an opposing second end;

means for securely retaining a portion of the perimeter edge of the display sheet at the first end of the adjustment bracket;

a brace configured for rigid attachment to the structure, the brace having an opening extending therethrough;

a coupling pin having a first end and an opposing second end, the first end of the coupling pin being mounted to the second end of the adjustment bracket so as to selectively slidably travel along the longitudinal length of the adjustment bracket, the second end of the coupling pin extending through the opening on the brace; and an advancing nut threadedly mounted on the second end of the coupling pin, the advancing nut being configured to bias against the brace so as to advance the coupling pin through the opening on the brace as the advancing nut is threaded onto the coupling pin.

2. An assembly as recited in claim 1, wherein the means for securely retaining comprises a coupling channel disposed along the length of the first end of the adjustment bracket, the coupling channel communicating with the exterior through a narrow mouth, the coupling channel and mouth being configured to slidably receive the portion of the perimeter edge of the display sheet.

3. An assembly as recited in claim 1, further comprising a receiving channel disposed along the length of the second end of the adjustment bracket, the receiving channel communicating externally through a narrow mouth, the first end of the coupling pin being slidably disposed within the receiving channel of the bracket.

4. An assembly as recited in claim 3, wherein the receiving channel has a substantially square transverse cross section.

5. An assembly as recited in claim 3, further comprising a retention nut threadedly engaged on the first end of the coupling pin, the retention nut being configured to slidably travel within the receiving channel of the adjustment bracket so as to preclude annular rotation of the retention nut therein.

6. An assembly as recited in claim 3, further comprising a fixed head mounted on the first end of the coupling pin, the fixed head being configured to slidably travel within the receiving channel of the adjustment bracket so as to preclude annular rotation of the fixed head therein.

7. An assembly as recited in claim 1, further comprising a positioning nut threadedly disposed on the coupling pin between the opposing ends thereof, the positioning nut being configured to selectively bias against the exterior surface of the adjustment bracket.

8. An assembly as recited in claim 1, further comprising at least three coupling pins having a first end mounted to the second end of the adjustment bracket such that each of the at least three coupling pins can selectively slidably travel along the length of the adjustment bracket.

9. An assembly as recited in claim 1, further comprising a cover bolted to at least one of the adjustment bracket and brace, the cover comprising a substantially flat base and a wing projecting at an angle from at least one side of the flat base, the cover being configured to at least substantially cover the adjustment bracket and the brace.

10. An assembly for mounting a display sheet having opposing first and second edges to a structure, the assembly comprising:

an elongated first adjustment bracket having a first end and an opposing second end, the first end being configured to receive and retain at least a portion of the first edge of the display sheet, the second end of the first adjustment bracket having a receiving channel extending along the length thereof;

means for securing the second edge of the display sheet to the structure;

an elongated first brace having at least three spaced apart openings extending therethrough; and at least three first coupling pins each having a first end and an opposing second end, the first end of each coupling pin being slidably retained within the receiving channel at the second end of the first adjustment bracket, the second end of each coupling pin extending through a corresponding opening on the elongated first brace.

11. An assembly as recited in claim 10, wherein the means for securing the second edge of the display sheet to the structure comprises:

a mounting bracket having an front face and a first end, the first end bounding a coupling channel configured to receive the second end of the display sheet; and means for securing the mounting bracket to the structure such that the front face of the mounting bracket is biased against the structure.

12. An assembly as recited in claim 10, wherein the means for securing the second edge of the display sheet to the structure comprises:

an elongated second adjustment bracket having a first end and an opposing second end, the first end being configured to receive and retain at least a portion of the second edge of the display sheet, the second end of the second adjustment bracket having a receiving channel extending along the length thereof;

an elongated second brace having a plurality of spaced apart openings extending therethrough; and a plurality of second coupling pins each having a first end and an opposing second end, the first end of each second coupling pin being slidably retained within the receiving channel at the second end of the second adjustment bracket, the second end of each second coupling pin extending through a corresponding opening on the elongated second brace.

13. An assembly as recited in claim 10, further comprising an advancing nut threadedly mounted at the second end of each of the first coupling pins, each advancing nut being configured to bias against the first brace.

14. An assembly as recited in claim 10, further comprising a cover including a substantially flat base and a wing projecting at an angle from each opposing side thereof, the cover being configured to substantially enclose the first adjustment bracket and the first brace over the structure when the cover member is mounted to the first adjustment bracket.

15. An assembly as recited in claim 10, further comprising a retention nut or fixed head positioned at the first end of each of the coupling pins, the retention nut or fixed head being configured to slidably travel within the receiving channel of the adjustment bracket.

16. An assembly as recited in claim 10, wherein the at least three spaced apart openings of the elongated first brace comprise:

a first opening formed at a longitudinal first end of the first brace;

a second opening formed at an opposing longitudinal second end of the first brace; and a third opening formed longitudinally between the first opening and the second opening.

17. An assembly for use on a structure, the assembly comprising:

a display sheet having a first edge and an opposing second edge, a retention line being disposed along at least a portion of the second edge;

a mounting bracket having a coupling channel extending along the length thereof, the coupling channel being configured to slidably receive at least a portion of the first edge of the display sheet;

means for securing the mounting bracket to the structure;

an adjustment bracket having a front face extending between a first end and an opposing second end, the first end bounding a coupling channel extending along the length of the adjustment bracket, the coupling channel being configured to slidably receive the retention line at the second edge of the display sheet, the second end of the adjustment bracket having a receiving channel extending along the length thereof;

a brace bounding an aperture extending therethrough and having a front face;

means for securing the brace to the structure;

a coupling pin having a first end and an opposing second end, the first end of the coupling pin being slidably disposed within the receiving channel of the adjustment bracket, the second end of the coupling pin extending through the aperture of the brace; and an advancing nut threadedly mounted on the second end of the coupling pin, the advancing nut being configured to bias against the brace so as to advance the coupling pin through the aperture of the brace as the advancing nut is threaded onto the coupling pin.

18. An assembly as recited in claim 17, wherein the mounting bracket and adjustment bracket are configured such that when the display sheet is tightly disposed therebetween, the distance between the flexible sheet and the structure is less than about 2 cm.

19. An assembly as recited in claim 17, wherein the display sheet comprises a retention line disposed at the first edge thereof.

20. An assembly as recited in claim 17, wherein the adjustment bracket and the brace are configured such that the front face of the adjustment bracket is slidably disposed directly adjacent to the structure when the brace is secured to the structure.

21. An assembly as recited in claim 17, further comprising a cover removably mounted directly to the adjustment bracket or brace, the cover being configured to cover at least a portion of the adjustment bracket and the brace.

22. An assembly as recited in claim 17, wherein the brace is spaced apart from the entire adjustment bracket.

23. An assembly for mounting a flexible sheet having a perimeter edge to a structure, the assembly comprising:

an adjustment bracket having a front face extending between a first end and an opposing second end;

means for securely retaining a portion of the perimeter edge of the flexible sheet along the first end of the adjustment bracket;

a brace configured for rigid attachment to the structure;

means extending between the adjustment bracket and the brace for selectively moving the bracket relative to the brace when the brace is rigidly mounted to the structure; and a cover removably mounted directly to the adjustment bracket or the brace, the cover comprising a substantially flat base and a wing projecting at an angle from each opposing side thereof, the cover substantially enclosing the bracket and the brace over the structure when the cover is mounted to the adjustment bracket or the brace.

24. An assembly as recited in claim 23, wherein the cover is bolted to the adjustment bracket or the brace.

25. An assembly as recited in claim 23, wherein the means for selectively moving the bracket comprises a coupling pin having a first end mounted to the second end of the adjustment bracket so as to selectively slidably travel along the length thereof, the second end of the coupling pin extending through a portion of the brace.

* * * * *

UNITED STATES PATENT AND TRADEMARK OFFICE

CERTIFICATE OF CORRECTION

PATENT NO. : 6,530,165 B2
DATED : March 11, 2003
INVENTOR(S) : Daniel A. Griesemer and Paul F. Bauer It is certified that error appears in the above-identified patent and that said Letters Patent is hereby corrected as shown below:

Title page,
Item [75], Inventors, change "Sandy," to -- Kaysville, --

Column 1,
Line 28, before "are located" change "billboard" to -- billboards --
Line 48, before "the building" change "mare" to -- mar --

Column 4,
Line 53, before "are typically" change "member" to -- members --

Column 6,
Line 26, after "wall 94" insert a period
Line 43, after "provided" change "have" to -- having --
Line 66, after "appreciate that" change "their" to -- there --

Column 7,
Line 36, after "appreciate that" change "their" to -- there --

Column 9,
Line 25, before "The described" insert a period

Column 10,
Line 53, before "front face" change "an" to -- a --

Signed and Sealed this

Thirtieth Day of September, 2003

JAMES E. ROGAN
*Director of the United States Patent and Trademark Office*